United States Patent [19]

Burési et al.

[11] 4,194,568

[45] Mar. 25, 1980

[54] DISCONNECTABLE RISER COLUMNS FOR UNDER WATER OIL WELLS

[75] Inventors: Georges Burési, Versailles; Olivier C. Roche, Marseille; Michel B. Viallard, Paris, all of France

[73] Assignee: Compagnie Francaise des Petroles, S.A., Paris, France

[21] Appl. No.: 921,539

[22] Filed: Jul. 3, 1978

[30] Foreign Application Priority Data

Jul. 1, 1977 [FR] France ..... 77 20268

[51] Int. Cl.[2] ..... E21B 7/12

[52] U.S. Cl. ..... 166/340; 285/18; 175/7; 166/359; 166/367

[58] Field of Search ..... 166/340, 350, 362, 359, 166/367, 365, 339, 338, 342, 343; 285/18, 26, 29, 33; 405/195; 175/7

[56] References Cited

U.S. PATENT DOCUMENTS

| | | | |
|---|---|---|---|
| 3,189,098 | 6/1965 | Haeber | 175/7 X |
| 3,280,908 | 10/1966 | Todd | 166/340 |
| 3,324,943 | 6/1967 | Price | 166/340 |
| 3,332,484 | 7/1967 | Watkins | 166/359 |
| 3,373,826 | 3/1968 | Ingram | 175/5 |
| 3,380,520 | 4/1968 | Pease | 166/359 X |
| 3,901,538 | 8/1975 | Blakely | 285/33 |
| 3,918,379 | 11/1975 | McNary et al. | 175/27 |
| 3,999,617 | 12/1976 | Ilfrey et al. | 166/350 |
| 4,098,333 | 7/1978 | Wells et al. | 175/7 X |
| 4,119,145 | 10/1978 | Tuson | 166/339 |
| 4,127,005 | 11/1978 | Osborne | 175/7 |

*Primary Examiner*—James A. Leppink
*Assistant Examiner*—Richard E. Favreau
*Attorney, Agent, or Firm*—Sughrue, Rothwell, Mion, Zinn and Macpeak

[57] ABSTRACT

A riser column particularly for use in deep water comprises a central tube connectable by its lower end to a submerged installation, for example a well, and including means permitting the central tube to oscillate relative to the installation, and connected at its upper end to a suspension table associated with a surface support, for example a platform, and bearing support means intermediate its ends at a level below that at which waves are effective, and a plurality of satellite tubes arranged around the central tube, each satellite tube having a bottom part extending from the intermediate support means to the submerged installation and a removable top part extending from the support means to suspension table and releasably connected to the bottom part thereof for withdrawal from the column following disconnection of the column from the installation, for example, in the event of a storm.

18 Claims, 13 Drawing Figures

DISCONNECTABLE RISER COLUMNS FOR UNDER WATER OIL WELLS

The invention relates to a riser column for connection to an oil well or other underwater installation or equipment, and particularly but not exclusively to a column for use in a sea where icebergs or storms are frequent occurrences.

Disconnectable riser columns used in shallow water less than 150 meters deep usually form a hole consisting of a central tube and a number of peripheral or satellite tubes disposed around the central tube. Action on the tubes of such a riser column can be taken, for instance, at given levels and the complete system is associated with means for controlling the various valves and connectors forming part of the well, the control means being connected to the surface by a line comprising a bunch of appropriate transmission and control cables. The complete system is supported at the upper end by a surface support. Movements of the surface support, caused by wind and sea swell, impart to the column, including the lower end of the central tube connected to the well, bending forces which are suppressed by the provision of an articulation between the lower part of the central tube and the well. The narrower satellite tubes, which can withstand the bending forces, are merely guided in appropriate passages of retaining means on the central tube. The complete system is maintained at a constant tension by appropriate tensioners disposed on the surface support.

The lower end of the riser column is disconnected from the well as and when required, for instance, in the event of a storm. The work of disconnection takes a relatively long time since each satellite tube has to be raised to the surface.

Columns of this kind, although satisfactory for use in depths of 150 meters, are scarcely a practical proposition at greater depths. For depths of the order of 1000 meters it has already been suggested, for example, that the complete system comprising the central tube and its satellite tubes should be divided into two parts, being a bottom part which remains secured to the well, and a top part which is about e.g. 80 meters long, which is disconnectable from the bottom part. Upon disconnection, the bottom part of the column remains supported and tensioned by buoyancy means also comprising connection means.

This suggestion helps to reduce the disconnection time, since only 80 meters for example of the total length of the column is raised to the surface, the bottom part of the column being below the effect of waves. Unfortunately, although disconnection is simple, reconnection of the top part of the column to the self-supporting connection means of the bottom part of the column presents several problems which are excessively complex in the case of medium length columns, for example of the order of 150 to 400 meters long.

The central tube of a 1000-meter long column can have, at its connection to the well head, an additional thickness which helps it to withstand bending forces and makes it unnecessary to have an articulation at the lower end of the column, which articulation would make it even more difficult to reconnect the top part of the column to the bottom part of the column. Unfortunately, this system is impracticable for shorter columns, since increases in the bending moment at the lower end of the central tube require an excessive increase in the thickness of the reinforcements and the size of the self-supporting connector, or make it necessary to provide the lower end of the central tube of the column with an articulation making it impossible to connect up the satellite tubes when the column tilts more than a few degrees.

According to the invention there is provided a riser column for connection between a submerged installation and surface support means, said riser column comprising:

a central tube;

means permitting oscillation of said central tube when connected to the submerged installation;

suspension means for association with the surface support means for suspension of said central tube;

support means connect to said central tube at a level below that at which waves are effective;

a plurality of satellite tubes arranged about said central tube, each said satellite tube comprising a bottom part extending between said support means and the submerged installation and a top part extending from said support means to said suspension means; and connecting means for releasably connecting said bottom parts of said satellite tubes to said top parts of said satellite tubes.

Preferably the central tube has an articulated said disconnectable lower end and the suspension means comprises a universally mounted suspension table which is slidable axially of a working shaft of the surface support means, the support means being arranged to lie at a depth of some 50 meters. In the event of a risk of surface impact, the central tube and the satellite tubes can be disconnected from the submerged installation by remote control and only the top parts of the satellite tubes are raised to the surface, with the result that swell has very little effect on the top part of the column. Once the top parts of the satellite tubes have been removed, the column can remain suspended from the surface support means substantially without stress and in any sea condition.

Consequently, and in contrast to the known methods of disconnection which require a relatively long time to raise either the complete column or just the top part thereof including the central and satellite tubes to the surface, the column is left suspended on the surface support means after merely the top parts of the satellite tubes have been disconnected from the bottom parts thereof and withdrawn, the bottom parts of the satellite tubes being supported by the support means. Since the waves can then have no further effect on the satellite tubes and do not have any great effect on the top part of the central tube, the effects of the swell are reduced considerably, the time taken to disconnect the column is appreciably shortened, and the risk of damage to the parts of the satellite tubes thus disconnected is obviated.

The riser column advantageously also comprises guide means for the lower ends of the bottom parts of the satellite tubes, the guide means being secured to the articulated base of the central tube and to a lower portion of the central tube, such base also comprising a connection base receiving control means for controlling the submerged installation.

Consequently, and even in heavy seas, not only can the complete base of the riser column and the whole of the top parts of the satellite tubes be disconnected very rapidly, but also the converse operation can be effected very rapidly because of the sliding articulation of the suspension table, the complete system being able to be readily lowered and connected to the submerged installation. Also, because of the arrangement of the guide means for the lower ends of the satellite tubes, if the central tube is already connected to the submerged installation the means for guiding the lower ends of the satellite tubes will be properly located despite any tilting of the column, the elements of the guide means being themselves articulated so as to obviate any stresses in the satellite tubes.

The invention will be more fully understood from the following description of an embodiment of a riser column according to the present invention, given by way of example only, with reference to the accompanying drawings:

Figure 1:
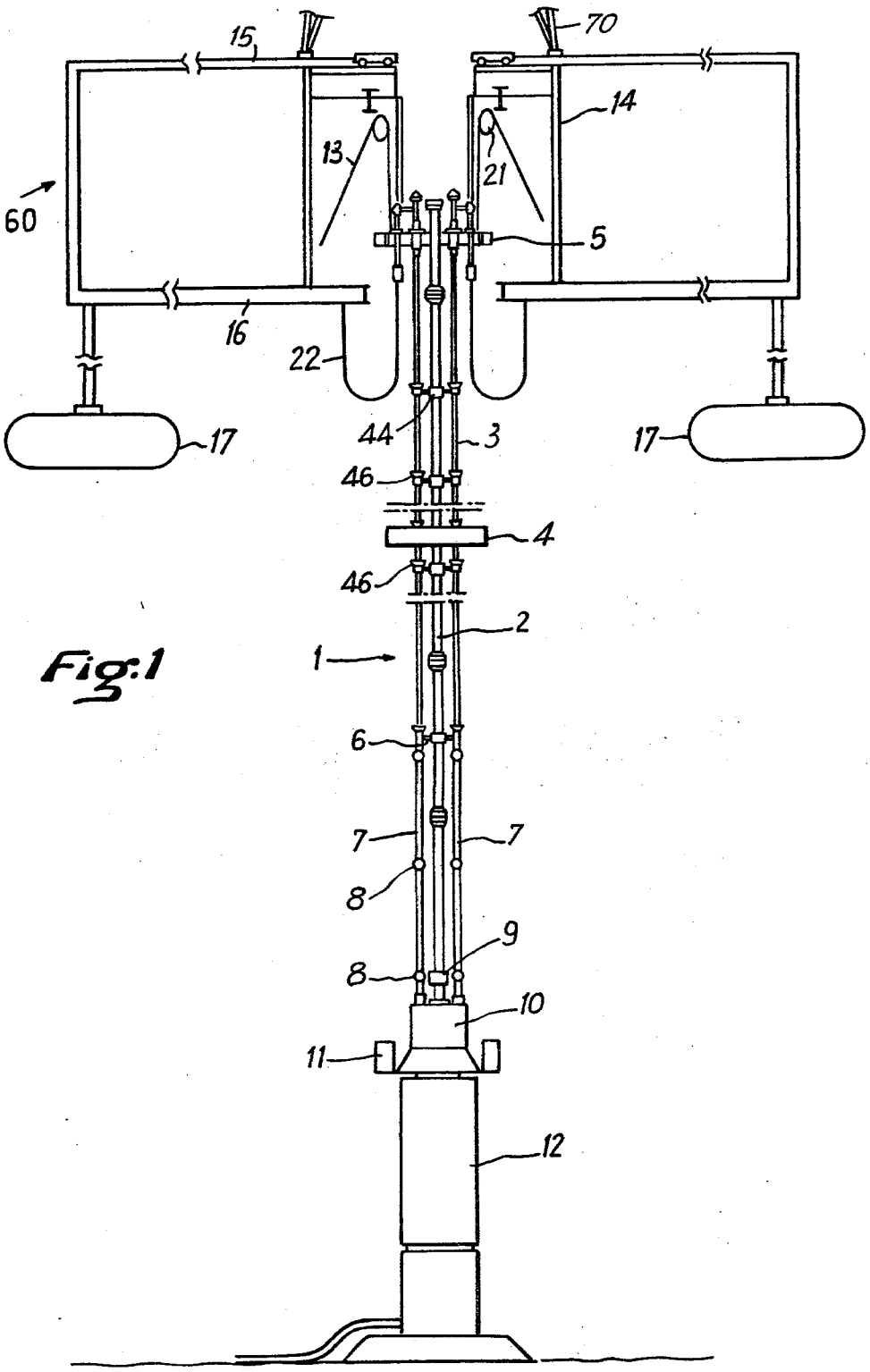
FIG. 1 is a diagrammatic view of an embodiment of a riser column according to the invention and connected to a submerged installation.

The riser column 1 shown in FIG. 1 comprises a central tube 2, a plurality of satellite lines or tubes 3 disposed therearound, an intermediate connection support 4 for releasable connection to the top parts of the satellite tubes 3 above the support 4, a suspension table 5 from which tubes 2 and 3 are suspended, and a support 6 which supports guide tubes 7 for the lower ends or tubes 3. The guide tubes include universal joints 8 and the lower end of the central tube 2 is associated with a swivel joint 9. The column 1 is associated with a re-entry guide cone 10 including releasable remote control means 11. The column is connected to a well head 12 or any other submerged installation or device such as a manifold. The table 5 is associated with a surface support 60 which is shown diagrammatically as comprising a working platform 15, a storage platform 16, a working shaft 14, a derrick 70 and floatation or buoyancy means 17.

Should a risk arise which makes it necessary to separate the column 1 from the well head 12 or other installation to which it is connected, the connectable portion diagrammatically illustrated by the re-entry guide cone 10 is disconnected and the whole of the column 1 is raised high enough to prevent the lower end of the column 1 from knocking against the sea bed or any other items of equipment, the top parts of the satellite tubes 3, which were originally connected to the intermediate support 4, being withdrawn.

Figure 2:
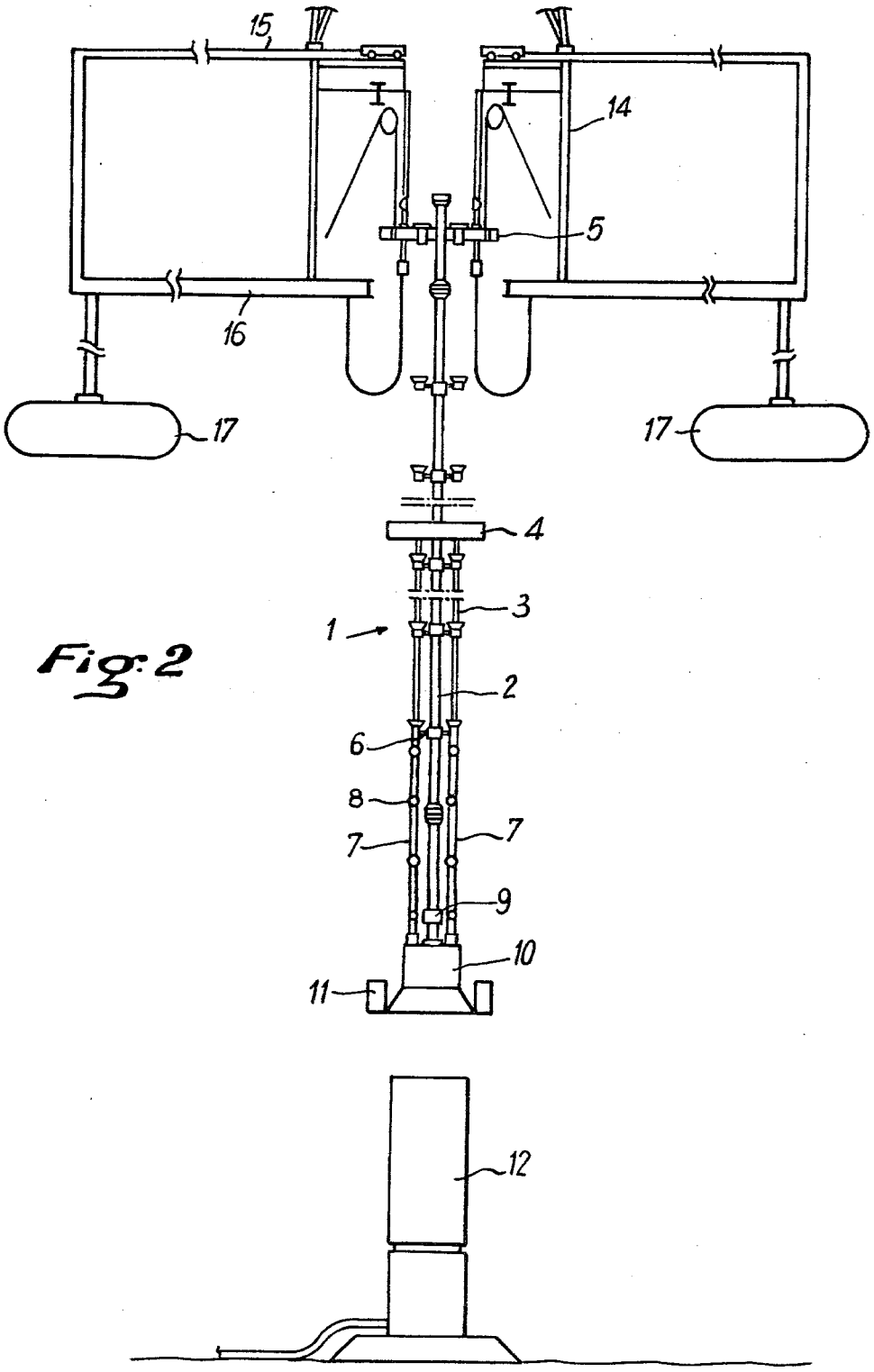
FIG. 2 is a diagrammatic view of the column of FIG. 1 after disconnection from the installation and withdrawal of the top parts of the satellite tubes.
Figure 3:
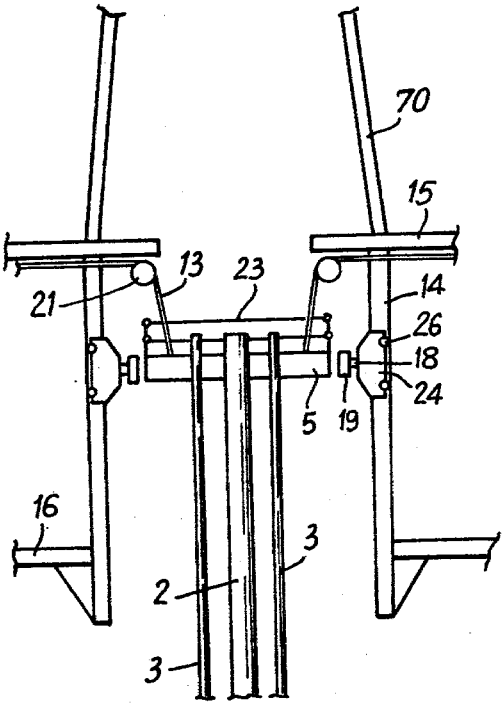
FIG. 3 is a diagrammatic elevation of the universal joint of the suspension means of the column, tensioners of the satellite tubes not being shown for the sake of clarity.
Figure 4:
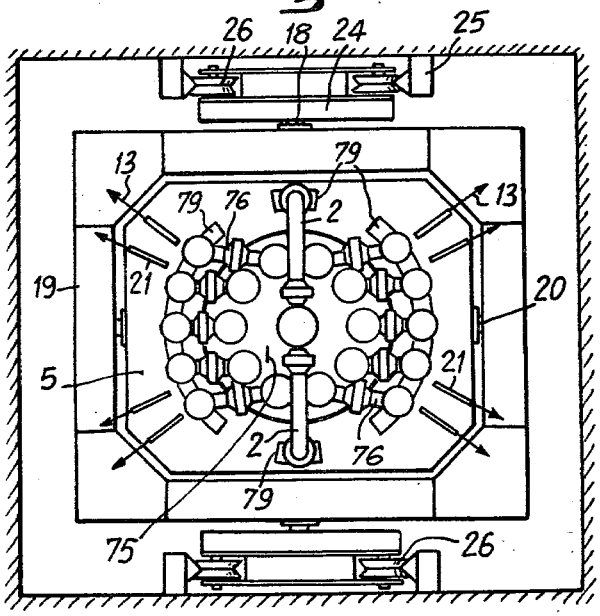
FIG. 4 is a plan view of the universal joint of FIG. 3.

Consequently, very little time is needed to change from the production condition shown in FIG. 1 to the instantaneous withdrawal position shown in FIG. 2, only the top parts of the satellite tubes 3 being raised to the surface, the top parts of the tubes 3 being of a reduced length corresponding only to the depth at which the waves cease to have any effect. As can be seen in FIG. 2, the top part of the central tube 2 without the satellite tubes offers very little resistance to the waves. So that it may support the complete column 1 without stressing, the head of the central tube 2 is secured axially of the table 5. It is then possible for the base of the column 1 to be disconnected immediately after closure, through the agency of the control means 11, of the valves controlling the central tube 2 and satellite tubes 3, and even before there has been time to disconnect the satellite tubes 3. Table 5 is suspended from the surface support 60 by a tensioner which may be of any suitable kind and is shown diagrammatically as comprising cables 13 connected to the table 5 and which pass round pulleys 21 (FIGS. 1, 3 and 4). The table 5 is mounted by a universal joint on support means 24. The universal joint is represented diagrammatically in FIG. 3 by pivots 18 about which a frame 19, carrying spindles 20 (FIG. 4) perpendicular to the spindles 18, can tilt. Consequently, whatever the weather conditions may be, the column 1 can be inclined to the working shaft 14 without causing over stressing.

Figure 5:
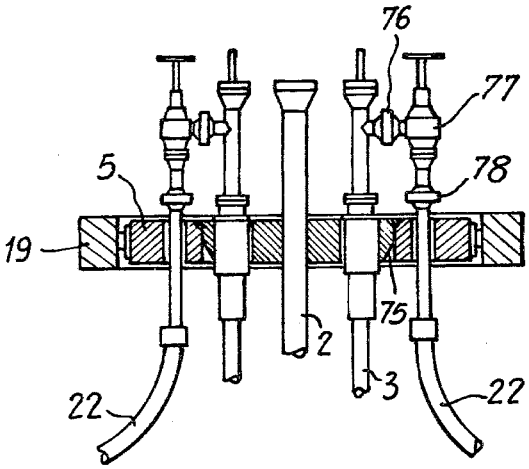
FIG. 5 is a diagrammatic view partly in section of the suspension means.

The table 5 has at its centre a releasable section 75 (FIGS. 4 and 5) supporting the tube 2 and the top ends of satellite tubes which are connected by connectors 76 to nozzles 77, the nozzles 77 being connected by connectors 78 to flexible discharge hoses 22 extending below the table 5. The central tube 2 is also connected to one or more flexible discharge hoses. The table 5 is formed with part-annular apertures 79, through which the top ends of the satellite tubes can be connected to the hoses 22 and which also serve as means for correcting the orientation of the column, the section 75 being able to take up the required orientation relative to the rest of the table 5.

Since it may be necessary to disconnect the top parts of the satellite tubes 3 in very difficult conditions, a walkway 23 (FIG. 3) extends around the table 5 and the spindles 18 are disposed on the slides or carriages 24 which have grooved rollers 26 (FIG. 4) which run on rails 25. This lateral guiding of the frame 19 of the universal joint supporting the table 5 prevents any dangerous lateral displacement of the top end of the column, more particularly when such displacement occurs simultaneously with inclination of the column 1. The advantage of the slides or carriages 24 movable parallel to the axis of the shaft 14 is that they reduce stresses caused by the effects of swell.

Figure 6:
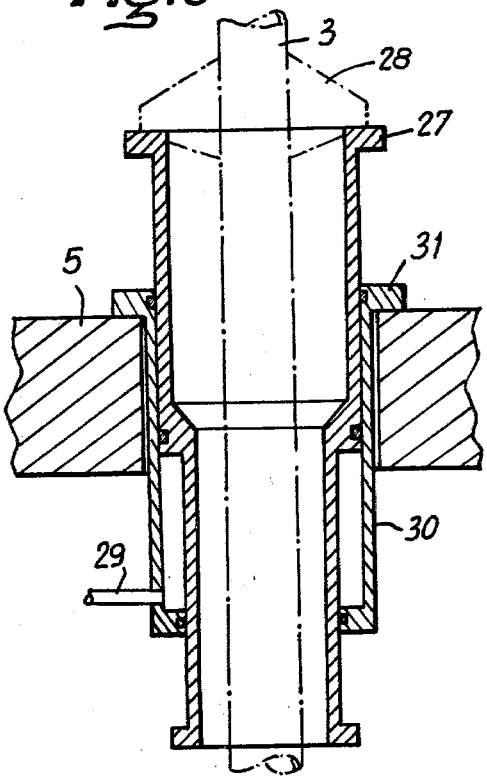
FIG. 6 is a sectional view of a tensioner for a satellite tube.

Each satellite tube 3 has its own hydraulic tensioning device comprising tensioner 27 which can be seen in FIG. 6 and which bears on a member 28 rigidly connected to the tube 3. Tension is produced by hydraulic pressure from a control line 29 connected to a chamber bounded by a cylinder 30 having a flange 31 which bears on the table 5. Each satellite tube 3 can therefore be moved independently of the others inside the cylinder 30 by means of its tensioner 27. Any one of the tubes 3 can therefore be readily withdrawn while the tensioning devices of the other tubes continue to be used.

If it is required to raise the releasable section 75 of the table 5 after closing the valve, it is possible to disconnect the connectors 78 and raise the system secured to the section 75 and including the tensioners 27.

The main advantages of the releasable section 75, in its combination with the universal joint 18–20 and its ability to move along the axis of the shaft 14, are therefore to facilitate disconnection and re-connection of the satellite tubes even in bad weather, to enable the column 1 to be oriented correctly by virtue of the shape of the apertures 79 around the section 75, and to improve the stability of the complete system.

In addition to the advantage resulting from the fact that the tensioners are of reduced size, there is a considerable reduction in the amplitude of the movement of the satellite tube heads relative to the surface support 60, because each tube remains perpendicular to the table 5 and the center thereof, on which the axis of the central tube is disposed, moves on the axis of the shaft 14 by means of the guide rails 25 of the carriages 24 of the universal joint 18–20. This feature makes it possible to delay the operation of withdrawing the top parts of the satellite tubes 3 even in bad weather conditions.

Figure 7:
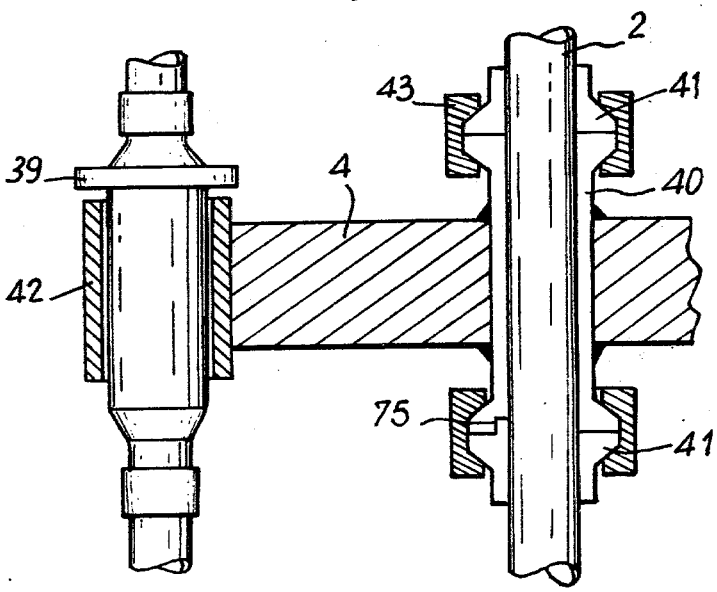
FIG. 7 is a diagrammatic section view of the intermediate support means.
Figure 8:
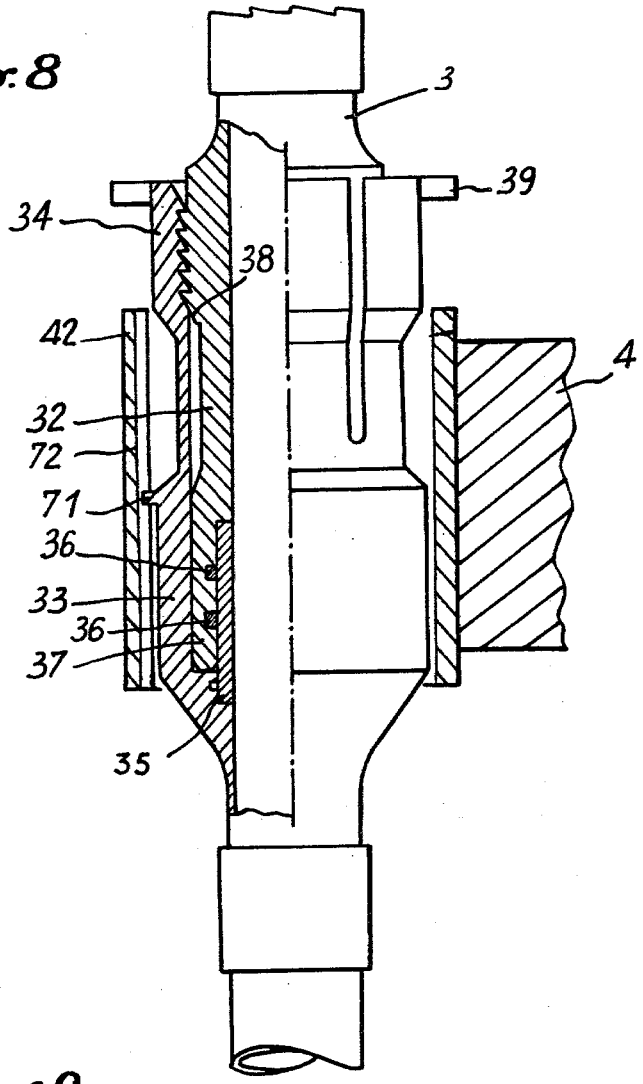
FIG. 8 is a section view of the connection means between the top and bottom parts of a satellite tube.

The connection of the satellite tubes to the support 4 can be seen in FIGS. 7 and 8. To remove the top part of each satellite tube 3, the base socket 32, originally introduced into the corresponding connector 33 just by being pushed in, is unscrewed. In the embodiment shown, the connector 33 bears on the support 4 by way of an abutment 71 which slides in a groove 72 in a guide tube 42 of support 4. At entry the bottom end of base socket 32 penetrates axially extending part-cylindrical resilient elements 34 which are screw-threaded internally in the opposite direction to the screwthreads of the conventional unions used to interconnect two consecutive lengths of tube 3. When the base socket 32 is fully home in the connection 33, the end portion 37 of socket 32, which has internal seals 36, engages over a ring 35 rigidly connected to the connector 33 to make the connection sealing-tight. The base socket 32 is locked by interengagement between screwthreads 38 on the socket 32 of the same pitch and direction as the screwthreads of the elements 34. After the base socket 32 has been connected to the connector 33, the complete satellite tube 3 is acted on by the tensioner 27 on the table 5 to take up the position shown on the left-hand side of FIG. 7. After disconnection of the part of tube 3, by unscrewing in the opposite direction to the unscrewing direction of conventional connectors, flange 39 of connector 33 bears on the top of tube 42 of the carrier plate 4. The plate 4 can be engaged on the central tube 2 is any known manner, for example, the plate may consist of two similar parts each rigidly secured to a half-cylindrical or shell-like member 40 engaged between two flanges 41 on tube 2. One of the flanges 41 may have a locating pin or the like 75 adapted to engage in a matching recess in one of the members 40 to locate thus 42 correctly relatively to various guide cones 46 for the satellite tubes 3. Clamping collars 43 secure the fixed flanges 41 to the flanges of the members 40.

Figure 9:
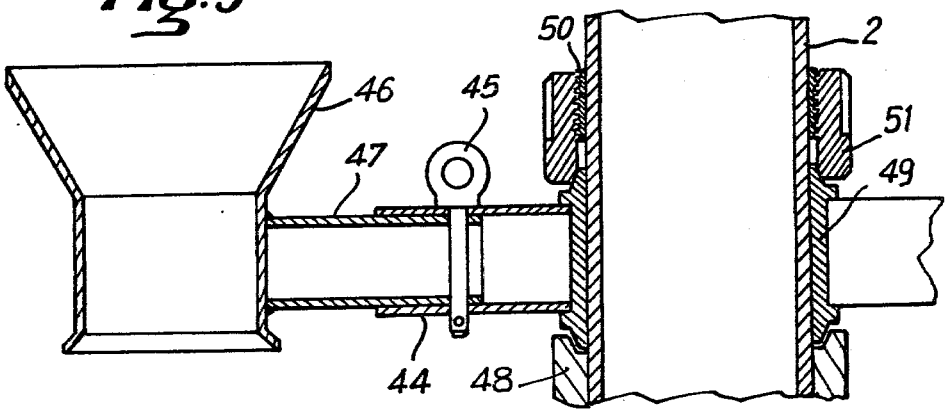
FIG. 9 is a view in axial section of a support for a satellite tube guide cone.

As can be seen in FIG. 9, the guide cones 46 for the tubes 3 are disposed on supports 44 carried by the central tube 2. The supports 44 can be fitted on the tube 2 in any suitable manner and are small enough to permit withdrawal of the central tube 2. As shown each support 44 comprises two half-cylindrical members 49 which are engaged round the tube 2 and each includes securing means 45 which enable the cones 46 to be withdrawn. In the example shown in FIG. 9, the securing means 45 take the form of an ordinary key connecting an arm 47 fast with the cone 46 to support 44. A bottom locking flange 48 rigidly secured to the central tube 2 can serve, if it has a pin or the like, to orient the members 49 of the support 44, the support 44 being formed with a recess co-operating with the pin to align all the cones 46. A screwthreaded ring 50 welded to the central tube 2 is adapted to receive a ring 51 for locking the upper parts of the members 49. Abutments (not shown) maintain the cone support arms 47 in their radial orientation on their supports 44.

Figure 10:
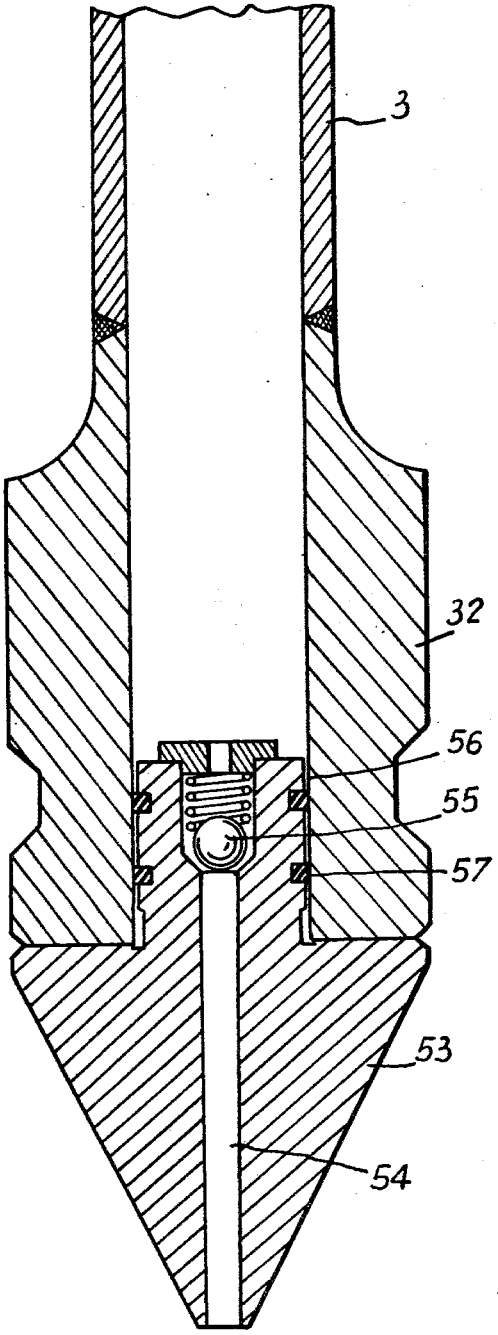
FIG. 10 is a sectioned view of guide means for guidance of the lower end of a satellite tube.

Although this kind of support 44 provides the required alignment of the axes of the cones 46, inclination of the whole of the column 1 may make it difficult to introduce the base socket 32 of a tube 3 into some of the guide cones 46 if the column moves. In this event, and because of the offset of the end of the satellite tube 3 from the guide cone 46, the end of the tube 3 may strike the surface of the cone 46. To avoid this disadvantage caused by column movements, the base socket 32 is provided with a guide 53 which is shown in FIG. 10 and which has a conical end made of a strong buoyant foam material. The guide 53 has an axial duct 54 associated with a check valve 55, such as a ball valve. An increase in the pressure in the tube 3 acts on a spring 56 to bias the ball 55 to a closed position closing the duct 54. O-ring seals 57 seal off the inner wall of tube 3 from the environmental medium. When the tube 3 is being lowered from the surface, water may enter it via the duct 54 and the open valve 55. At each entry into a cone 45 the conical end of the guide 53 co-operates with the cone 46 to ensure that, even though the column may be at a considerable inclination, the end of the base socket 32 never knocks against the edge of a cone 46. When, after passing through the various cones 46, the tube 3 reaches a position near the connector 33 on the support 4, the pressure inside the tube 3 is increased from the surface so as to close the valve 55 and then expel the guide 53 which, being of low density, floats up to the surface of the sea on its own.

Figure 11:
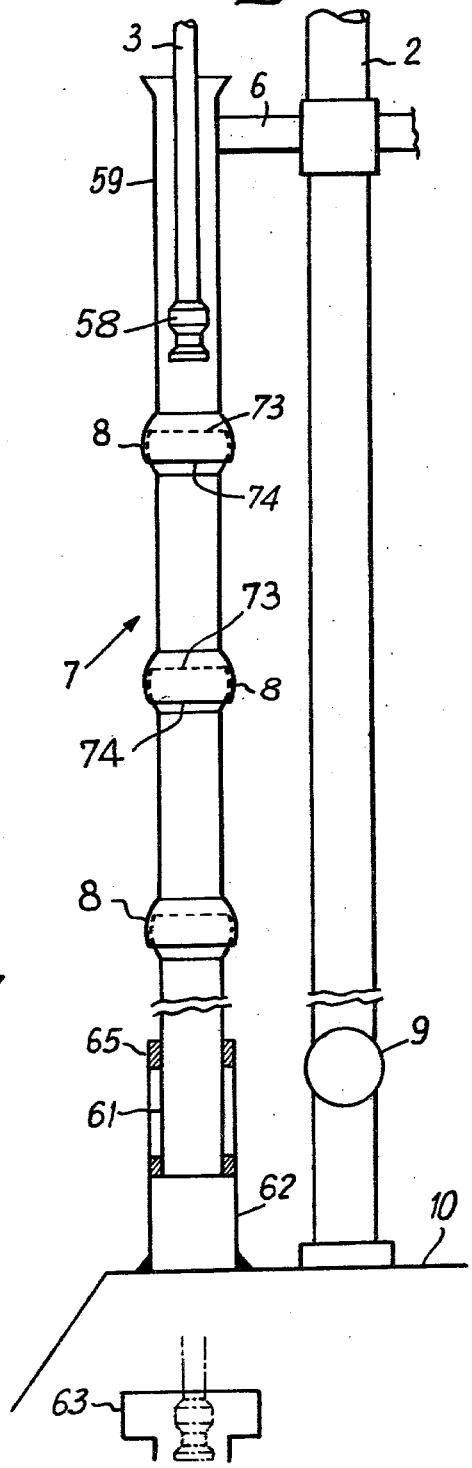
FIG. 11 is a diagrammatic elevation of the guide means for guiding the lower ends of the bottom parts of the satellite tubes.

The same guide 53 can be used during lowering of a satellite tube onto an hydraulic connectior 63, as shown in FIG. 11, in the assembly 10. The guide 53 is in this case expelled from the end 58 of the tube 3 as it approaches the guide tube rigidly connected to the lower part of central tube 2 by the support 6. The satellite tube 3 can therefore readily enter the upper part 59 of guide tube 7, part 59 being far enough away from cone 10 to ensure that there is no overstressing of this portion of tube 3 in the event of the central tube 2, which is pivoted to swivel joint 9, being inclined. Similarly, to reduce stressing of the guide tube 7, universal joints 8 having abutments 73, 74 are provided so that the guide tube 7 can bend without exceeding the limits permitted for bending of the satellite tube 3, and the lower end portion 61 of tube 7 is slidable in a tube 62 rigidly secured to cone 10. Abutments 65 prevent end portion 61 from withdrawing from tube 62. Consequently, whatever movements the column may make e.g. because of the presence of a strong current causing the column 2 to tilt around its pivot 9, the lower end 58 of the satellite tube 3 can be introduced into the first element of guide tube 7 for guidance to the connector 63. Since the satellite tube 3 is free to slide relatively to its guide tube 7, it can be flexible enough to ensure that, despite any inclination of the central tube 2 on its swivel joint 9, no strengthening of the satellite tube 3 is required to withstand the stresses which it would experience in the absence of its guide tube 7, the length of which can be for example some 20 meters. In this way the central tube combines flexibility, because of its articulation 9, with rigidity, because of its large cross-section, the rigidity of the guide tube 7 also being compensated for by the flexibility of the elements 8 within the limits permitted by the abutments 73, 74 and by the mobility of the lower end of guide tube 7 in tube 62.

Figure 12:
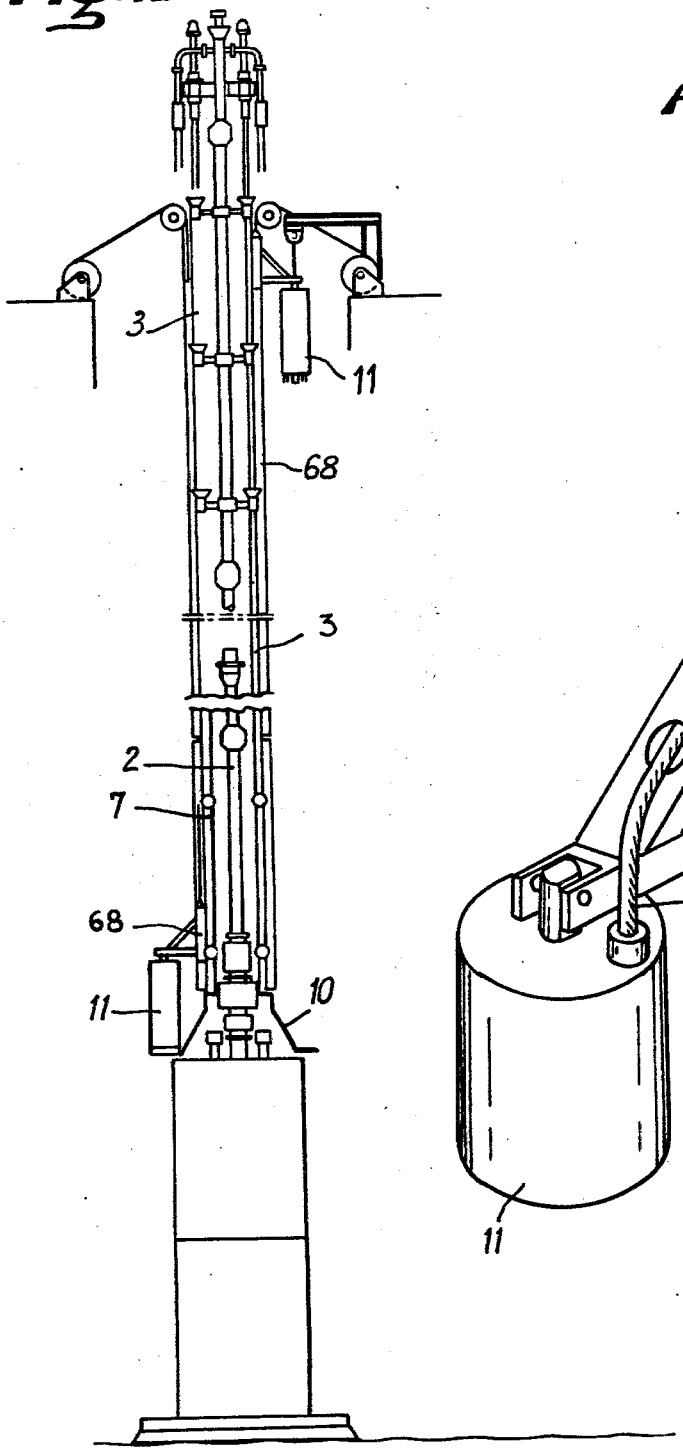
FIG. 12 is a diagrammatic elevation showing the support and guide means for the remote control means.
Figure 13:
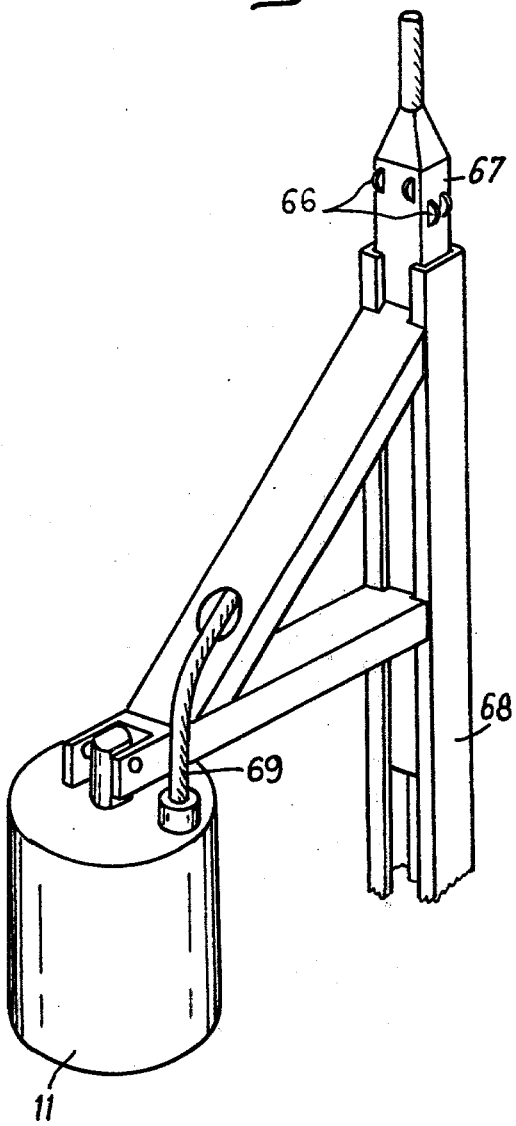
FIG. 13 is a diagrammatic perspective view of the support and guide means for the control means.

The hydraulic connector controls made by means 11 control the various valves and unions of the well. As can be seen in FIGS. 12 and 13, so that the required elements may be controlled readily, the control means 11 is preferably mounted on a slider 67 having rollers 66 running on a rail 68 secured to the central tube 2, in the same way as are the guide cones 46, the rail 68 being mounted on arms disposed between two arms supporting cones 46. In the embodiment shown, the control cable 69 is a self-supporting multiple cable providing individual control for each of the unions or connectors 63 (FIG. 11) to which the satellite tubes 3 are connected. The cable 69 also assists in control of the various valves for opening and closing the tubes 3.

While only one embodiment of a riser column has been described, it will be appreciated that many additions, deletions and substitutions could be made to the various systems described without departure from the scope of the invention. For example the boxes 11 may be fixedly or releasably disposed on the systems for connection to whatever form of well or production installations may be used.

What is claimed is:

1. A riser column for connection between a submerged installation and surface support means, said riser column comprising:

a central tube;

means permitting oscillation of said central tube when connected to the submerged installation;

suspension means for association with the surface support means for suspension of said central tube;

support means connected to said central tube at a level below that at which waves are effective;

a plurality of satellite tubes arranged about said central tube, each said satellite tube comprising a bottom part extending between said support means and the submerged installation and a top part extending from said support means to said suspension means; and connecting means for releasably connecting said bottom parts to said satellite tubes to said top parts of said satellite tubes, said connecting means including means for retaining the bottom parts of said satellite tubes suspended underwater with respect to said submerged installation upon the disconnection of said top and bottom parts of said satellite tubes.

2. A column according to claim 1, wherein said support means is orientatably mounted on said central tube and includes ducts for said satellite tubes, each said connecting means including a flange connected to a respective said satellite tube and which bears on said support means when said column is not connected to the submerged installation to suspend said satellite tube from said support means.

3. A column according to claim 2, wherein the lower ends of said top parts to said satellite tubes comprise means for rapid connection to the upper ends of said bottom parts of said satellite tubes suspended from said support means.

4. A riser column according to claim 3 including slide means, rail means, and universal mounting means for mounting said suspension means on the surface support means, said mounting means being mounted on said slide means slidable along said rail means extending parallel to the axis of the working shaft of the surface support means.

5. A riser column according to claim 4, including tensioning means for supporting said suspension means on the surface support means, and tensionser means in respect of each said satellite tube for supporting said respective satellite tube on said suspension means, said tensioner means being hydraulic and being slidable axially of said suspension means.

6. A column according to claim 5, wherein each said tensioner means includes a piston which bears on a member rigidly secured to the upper end of said respective satellite tube, and a cylinder which bears on said suspension means.

7. A column according to claim 5 or claim 6, further comprising flexible tube means, wherein the upper ends of said central and satellite tubes lie above said suspension means and are connected to said flexible tube means disposed below said suspension means, said suspension means comprising a table having a releasable central portion, said tubes extending through said central portion and being connected to said flexible tubes by part-annular apertures arranged in a circle centred on the centre of said table, said centre of said table moving axially of the submerged installation as said universal joint moves vertically.

8. A column according to claim 1, wherein said support means comprises a plate fitted to said central tube by two flanges rigidly secured thereto and two locking devices.

9. A column according to claim 8, further comprising a connector lower part, wherein the upper end of said bottom part of each said satellite tube carries retaining means for bearing on said support means, and connecting means comprising upper internally toothed cylinder sectors having internal toothings, and rigidly connected to said connector lower part forming a cylindrical recess for receiving the lower end of said top part of said satellite tube, said lower end of said top part of said satellite tube having internal sealing means for bearing on a part of said recess, and external screw-threadings co-operating with said internal toothings of said sectors for locking engagement therewith by axial movement of said lower end of said top part of said satellite tube.

10. A column according to claim 9, wherein the upper ends of said bottom parts of said satellite tubes comprise at least one abutment co-operating with said support means during disconnection of said top parts of said satellite tubes therefrom, the screwthreadings of said connecting means being of opposite direction between consecutive elements of said satellite tubes.

11. A column according to claim 1, including releasable guide cones and orientatable supports mounted on said central tube and carrying said releasable guide cones for said satellite tubes.

12. A column according to claim 11, including guide means for insertion in the lower ends of said satellite tubes, said guide means being ejectable and recoverable.

13. A column according to claim 11, comprising, at some distance from its lower end, a guide tube support, and guide tubes supported thereby and for said satellite tubes, the ends of said guide tubes being aligned with said satellite tube guide cones, said guide tubes including means for limiting buckling thereof for the extent of said satellite tubes which are inside said guide tubes.

14. A column according to claim 13, wherein each said guide tube includes at the lower end thereof at least one fixed portion and a movable portion slidable relative thereto.

15. A column according to claim 14, wherein each said guide tube, between said movable sliding portion and said guide tube support which is rigidly secured to said central tube, comprises a plurality of rigid elements pivotally connected together.

16. A column according to claim 1, further comprising a guide rail and remote control means, wherein said central tube comprises supports for said guide rail for said remote control means.

17. A column according to claim 16, further comprising a re-entry guide cone, wherein said remote control means is connectable to said re-entry guide cone for connection to the submerged installation, said cone supporting said fixed portions of said guide tubes.

18. A riser column for connection between a submerged installation and surface support means, said riser column comprising:

a central tube;

unipivot means permitting horizontal and vertical oscillation of said central tube when connected to be submerged installation;

suspension means having said unipivot attached thereto, for association with the surface support means for suspension of said central tube;

support means connected to said central tube at a level below that at which waves are effective;

a plurality of satellite tubes arranged about said central tube, each said satellite tube comprising a bottom part extending between said support means and the submerged installation and a top part extending from said support means to said suspension means; and connecting means for releasably connecting said bottom parts to said satellite tubes to said top parts of said satellite tubes, the portion of said riser column below said support means being suspended only from said central tube by means of said unipivot attached to said suspension means to thereby provide said horizontal and vertical oscillation.

* * * * *